United States Patent [19]

Bout

[11] Patent Number: 4,915,651

[45] Date of Patent: Apr. 10, 1990

[54] COAXIAL CONNECTOR

[75] Inventor: Willem J. F. Bout, Huizen, Netherlands

[73] Assignee: AT&T Philips Telecommunications B. V., Hilversum, Netherlands

[21] Appl. No.: 258,356

[22] Filed: Oct. 17, 1988

[30] Foreign Application Priority Data

Oct. 26, 1987 [NL] Netherlands ..... 8702537

[51] Int. Cl.[4] ..... H01R 17/04

[52] U.S. Cl. ..... 439/578

[58] Field of Search ..... 439/578, 579, 580, 581, 439/582, 583, 584, 585, 372

[56] References Cited

U.S. PATENT DOCUMENTS 3,486,161 12/1969 Kraus et al. ..... 439/578 X 4,734,050 3/1988 Negre et al. ..... 439/578 X

*Primary Examiner*—Z. R. Bilinsky

*Attorney, Agent, or Firm*—Peter Visserman

[57] ABSTRACT

The connector comprises two conector portions (1, 3), each of which comprises an inner contact member (5, 49) which is coaxially surrounded by an outer contact member (23, 59) whereto it is mechanically connected via an insulating body (9, 53). At its free end each contact member (5, 23, 49, 59) comprises a contact face (5', 23', 49', 59') which extends perpendicularly to its axis, at least one (5', 59') of each pair of cooperating contact faces (5', 23'; 49', 59') being so large that, after the coupling of the two connector portions (1, 3), a suitable electrical connection is realized between the cooperating contact members (5, 23; 49, 59) it the axes of the two connector portions have been displaced with respect to one another no more than a predetermined distance (d). The contact members (5, 23) of at least the first connector portion (1) are independently movable in the axial direction against the force of a spring (19, 29) in order to compensate for axial tolerances in the position of the connector portions (1, 3).

3 Claims, 1 Drawing Sheet

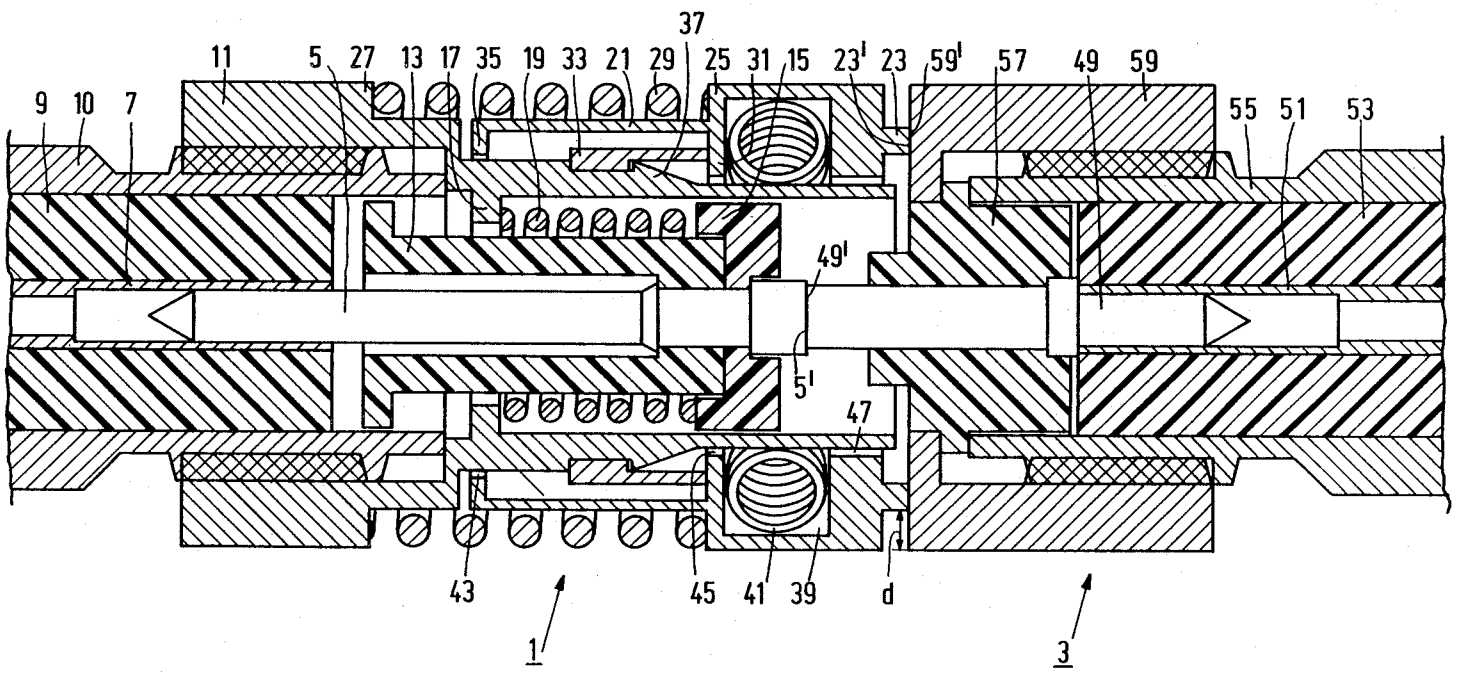
53
51
55
59
49
57
59'
23
23'
15
31
25
37
29
21
33
19
35
17
13
27
5
11
7
10
9
49'
5'
47
d
39
41
45
43
3
1

COAXIAL CONNECTOR

The invention relates to a coaxial connector, comprising a first and a second connector portion, each of which comprises an electrically conductive inner contact member which is coaxially surrounded by an electrically conductive outer contact member whereto it is mechanically connected via an electrically insulating body.

A connector of this kind is known, for example from U.S. Pat. No. 4 506 939 and can be used for interconnecting electronic components, for example printed circuit boards. When only one signal is to be transferred from one component to the other, only one connector is required. In that case the two portions of the connector can be exactly aligned with respect to one another, after which the permanent connection between the two components can be realized, for example by means of screws. However, in the case of a comparatively large number of signal paths between the two components, requiring a corresponding large number of connectors, it is difficult to align the two portions of each connector exactly with respect to one another. This is because the connector portions are rigidly connected to the components, and, due to tolerances in the position occupied by each connector portion on the relevant component, not all cooperating connector portions will be exactly aligned with respect to each other when the components are interconnected. Consequently, some of the electrical connections between the components will be of an inferior quality or will even be absent.

The above problem could in principle be solved by realizing the connections by way of flexible cables, thus circumventing the mechanical tolerances. This solution, however, has the drawback that it prolongs the signal paths so that a delay can be incurred during the transfer of the signals. Moreover, the connectors must be connected to the cables, requiring additional mounting time and making the construction more expensive.

It is an object of the invention to provide a connector of the kind set forth which is capable of realizing a high-quality electrical connection, even in the case of deviations in the mutual positions of the connector portions, and which is very compact. To achieve this, the connector in accordance with the invention is characterized in that at the free end of each of the contact members there is provided a contact face which extends perpendicularly to the axis of the contact member, corresponding contact faces of the two connector portions being capable of cooperating, at least one of each pair of cooperating contact faces being so large that, after the coupling of the two connector portions, a suitable electrical connection exists between the cooperating contact members if the axis of the first connector portion has been shifted with respect to the axis of the second connector portion over no more than a predetermined distance, the contact members of at least the first connector portion being independently movable in the axial direction, against the force of a spring, with respect to the insulating body.

As a result of this construction, the cooperating contact faces will be suitably positioned one against the other even when the positions of the two connector portions mutually deviate in the radial or the axial direction.

An embodiment of the connector in accordance with the invention which has a simple construction and which is very reliable is characterized in that at least the first connector portion comprises an electrically conductive, tubular extension which is rigidly connected to the insulating body and the inner surface of which serves as a bearing for an axially movable inner contact carrier which carries the inner contact member, its outer surface acting as a bearing for an axially movable outer contact carrier which carries the outer contact member, an inner coiled spring being provided between a radially outwards projecting shoulder of the inner contact carrier and a radially inwards projecting shoulder of the extension, an outer coiled spring being provided between radially outwards projecting shoulders of the outer contact carrier and the extension.

For coaxial connections it is generally important that the outer conductor is continuous and does not exhibit apertures wherethrough electromagnetic radiation of high frequency could escape from the inner conductor to the environment or vice versa. Therefore, the outer contact carrier should be electrically conductively connected to the outer surface of the extension over its entire circumference also during and after axial displacement of the outer contact carrier.

In order to ensure such an electrical connection, a preferred embodiment of the connector in accordance with the invention is characterized in that in the outer contact carrier there is provided a chamber which opens towards the interior and in which there is arranged an elastic, electrically conductive ring which is electrically conductively connected to the outer contact member and the extension.

It is to be noted that an example of such an electrically conductive ring is known per se from FR No. 2 209 483.

A further embodiment in which the electrical continuity of the outer conductor is also ensured when the axes of the two connector portions enclose a small angle with respect to one another is characterized in that the outer contact carrier surrounds the extension with a radial clearance so that the outer contact carrier can be tilted through a predetermined angle with respect to the extension.

The invention will be described in detail hereinafter with reference to the drawing which represents a longitudinal sectional view of an embodiment.

The coaxial connector shown comprises a first connector portion 1 and a second connector portion 3, each of which can be secured to an electric component (not shown). The first connector portion 1 comprises an electrically conductive inner contact member 5 in the form of a metal pin, one end of which is electrically connected to and is axially displaceable in a metal sleeve 7 which may be electrically connected to a conductor of a first electronic component (not shown). The free end (the right-hand end in the Figure) of the inner contact member 5 is provided with a contact face 5 which extends perpendicularly to its axis. The sleeve 7 is secured in an electrically insulating body 9, for example a plastics body. On the insulating body 9 there is secured, via a sleeve 10, an electrically conductive tubular extension 11 which coaxially surrounds the inner contact member 5 and which can be electrically connected to a ground terminal (not shown) of the first electronic component. The inner contact member 5 is secured in an inner contact carrier 13 of an electrically insulating material which is journalled so as to be axially displaceable in the extension 11, the inner surface of the extension serving as a bearing. Near its end which is remote from the insulating body 9 (the right-hand end in the Figure), the contact carrier 13 comprises a radially outwards projecting shoulder 15; the extension 11 comprises a radially inwards projecting shoulder 17 which is arranged nearer to the insulating body. Between these two shoulders 15, 17 there is provided an inner coiled spring 19 which surrounds the inner contact carrier 13 and which exerts an opposing force in the case of an axial displacement of the inner contact carrier in the direction of the insulating body 9.

The outer surface of the extension 11 serves as a bearing for an axially displaceable outer contact carrier 21 which carries an annular, electrically conductive outer contact member 23 at its end which is remote from the insulating body 9, which outer contact member coaxially surrounds the inner contact member 5. At its free end (the right-hand end in the Figure) the outer contact member 23 is provided with a contact face 23 which extends perpendicularly to its axis. In the embodiment shown, the outer contact member 23 with the outer contact carrier 21 is made of metal as one unit. The outer contact carrier 21 and the extension 11 both comprise a radially outwards projecting shoulder 25, 27, respectively, wherebetween there is provided an outer coiled spring 29 which surrounds the outer contact carrier and which exerts an opposing force in the case of an axial displacement of the outer contact carrier in the direction of the insulating body 9. The displacement of the outer contact carrier 21 in the direction of the insulating body 9 is limited in that a first inwards projecting shoulder 31 formed on the outer contact carrier abuts against the side of a resilient clamping ring 33 which is remote from the insulating body. The displacement in the opposite direction under the influence of the outer coiled spring 29 is limited in that a second inwards projecting shoulder 35 formed on the outer contact carrier 21 abuts against the side of the clamping ring 33 which faces the insulating body 9. The clamping ring 33 thus forms an abutment which limits the displacement of the outer contact carrier 21 in both directions. When the outer contact carrier 21 is mounted, first the outer coiled spring 29 is provided around the extension 11, after which the clamping ring 33 is slid onto the extension as far as the ramp-like portion 37 thereof. Subsequently, the outer contact carrier 21 is slid onto the extension 11, the first inwards projecting shoulder 31 then pressing the clamping ring 33, opening itself, over the portion 37. After having passed the portion 37, the clamping ring 33 is closed again so that it is locked behind the portion and the outer contact carrier 21 can no longer be removed from the extension 11. Mounting, therefore, is particularly simple and inexpensive.

An annular chamber 39 which opens towards the interior is formed in the outer contact member 21, near the end which is remote from the insulting body 9. Before the outer contact carrier 21 is slid onto the extension 11, an elastic, electrically conductive ring 41 is arranged in this chamber. After the outer contact carrier 21 has been slid on as described above, the opening of the chamber 39 is closed by the end portion of the extension 11, so that the conductive ring 41 is locked up. In the example shown, the conductive ring 41 consists of a coiled conductor which is bent so as to form a ring when inserted into the chamber 39, its turns then occupying a somewhat slanted position. A ring of this kind is described, for example in FR No. 2 209 483. Other constructions of the ring 41 are also feasible, for example a ring made of conductive rubber or metal wool. The ring 41 is electrically conductively connected to the extension 11 as well as to the metal of the outer contact carrier 21 and hence also to the outer contact member 23.

The outer contact carrier 21 surrounds the extension 11 with a predetermined radial clearance as denoted by the references 43, 45 and 47. As a result, the outer contact carrier 21 is capable of moving with respect to the extension 11 not only in the axial direction as described above, but can also be tilted through a predetermined small angle so that the axes of the outer contact member 23 and the inner contact member 5 need not always coincide exactly. Tilting, of course, takes place only under the influence of a moment exerted on the outer contact carrier 21. In the absence of such a moment, the inner contact member 5 and the outer contact member 23 are exactly coaxial.

The second connector portion 3 comprises an electrically conductive inner contact member 49 in the form of a metal pin, one end of which is immovably secured in and makes electrical contact with a metal sleeve 51 which can be electrically connected to a conductor of a second electronic component (not shown). At its free end (the left-hand end in the Figure) the inner contact member 49 is provided with a contact face 49′ which extends perpendicularly to its axis. The sleeve 51 is secured in an electrically insulating body 53, for example a plastics body. On the insulating body 53 there is rigidly secured an electrically conductive tubular extension 55 which coaxially surrounds the inner contact member 49. Between the free end portion of the extension 55 and the inner contact member 49 there is provided an electrically insulating supporting body 57. An annular, electrically conductive outer contact member 59 is immovably secured on the extension 55, which outer contact member can be electrically connected, via the extension, to a ground terminal (not shown) of the second electronic component. The free end (the left-hand end in the Figure) of the outer contact member 59 is provided with a contact face 59′ which extends perpendicularly to its axis.

When the two connector portions 1, 3 are coupled to one another in the manner shown in the Figure, the contact faces 5 and 49′ cooperate for electrical interconnection of the inner contact members 5 and 49 and the contact faces 23′ and 59′ cooperate for electrical interconnection of the outer contact members 23 and 59. As has already been stated, the connector portions 1, 3 are mounted on electronic components which are to be mechanically interconnected (for example, via a screwed or clamping connection) in order to couple the connector portions. Due to mechanical tolerances, it may readily occur that the two connector portions 1, 3 are not arranged exactly with their axes one in the prolongation of the other, or that the distance between the insulating bodies 9 and 53 is larger than shown in the Figure. As a result of the described construction of the first connector portion 1, however, an excellent electrical connection can then still be established. A displacement of one of the connector portions 1, 3 in the axial direction is compensated for in that the inner contact member 5 and the outer contact member 23 are independently axially displaceable against the force of the inner coiled spring 19 and that of the outer coiled spring 29, respectively. A displacement of one of the two connector portions in the radial direction does not have an adverse effect because the radial dimensions of the contact faces 5' and 59' are larger than required in the case of exactly correct positioning of the connector portions. A displacement in the radial direction over a distance d has no effect whatsoever on the connection between the outer contact members 23 and 59 and does not have a noticeable effect on the connection between the inner contact members 5 and 49 because even a point-shaped contact between the contact faces 5' and 49' still suffice for satisfactory signal transfer. Tilting of the two connector portions 1 and 3 with respect to one another causes the outer contact member 21 to be tilted also, due to the clearance denoted by 43, 45 and 47, so that the contact faces 23' and 59' continue to contact one another over the entire circumference for as long as the angle between the axes of the two connector portions 1, 3 does not exceed a predetermined value. Inter alia because of the elastic, electrically conductive ring 41 which ensures a fully closed electrical connection between the extension 11 and the outer contact carrier 21, the two extensions 11 and 55 form a closed electrically conductive shield in conjunction with the two outer contact members 23 and 59 and the outer contact carrier 21.

In the described embodiment, only the first connector portion 1 comprises axially displaceable contact members 5, 23 and a tiltable outer contact carrier 21. It will be apparent that the second connector portion 3 can be constructed in the same way as the first connector portion. In that case even larger tolerances can be compensated for.

What is claimed is:

1. A coaxial connector, comprising a first and a second connector portion, each of which comprises an electrically conductive inner contact member which is coaxially surrounded by an electrically conductive outer contact member whereto it is mechanically connected via an electrically insulating body, and a spring, the free end of each of the contact members having a contact face which extends perpendicularly to the axis of the contact member, corresponding contact faces of the two connector portions being capable of cooperating, at least one of each pair of cooperating contact faces having a predetermined contact area such that, after the coupling of the two contact portions, a suitable electrical connection exists between the cooperating contact members if the axis of the first connector portion has been shifted with respect to the axis of the second connector portion over no more than a predetermined distance, the contact members of at least the first connector portion being independently movable in the axial direction, against the force of the spring with respect to the insulating body, at least the first connector portion comprising an electrically conductive, tubular extension which is rigidly connected to the insulating body and the inner surface of which serves as a bearing for an axially movable inner contact carrier which carries the inner contact member, its outer surface acting as a bearing for an axially movable outer contact carrier which carries the outer contact member, an inner coiled spring being provided between a radially outwards projecting shoulder of the inner contact carrier and a radially inwards projecting shoulder of the extension, an outer coiled spring being provided between radially outwards projecting shoulders of the outer contact carrier and the extension.

2. A connector as claimed in claim 1, characterized in that in the outer contact carrier there is provided a chamber which opens towards the interior and in which there is arranged an elastic, electrically conductive ring which is electrically conductively connected to the outer contact member and the extension.

3. A connector as claimed in claim 1 or 2, characterized in that the outer contact carrier surrounds the extension with a radial clearance so that the outer contact carrier can be tilted through a predetermined angle with respect to the extension.

* * * * *